US007717504B2

(12) United States Patent
Centracco et al.

(10) Patent No.: US 7,717,504 B2
(45) Date of Patent: May 18, 2010

(54) CHILD SEAT APPARATUS

(76) Inventors: Zahia Centracco, 1811 Wilshire Blvd., Oklahoma City, OK (US) 73116; Danielle Batchelon, 3764 Rice Blvd., Houston, TX (US) 77005

( * ) Notice: Subject to any disclaimer, the term of this patent is extended or adjusted under 35 U.S.C. 154(b) by 0 days.

(21) Appl. No.: 12/171,369

(22) Filed: Jul. 11, 2008

(65) Prior Publication Data

US 2009/0015041 A1 Jan. 15, 2009

Related U.S. Application Data

(60) Provisional application No. 60/959,408, filed on Jul. 13, 2007.

(51) Int. Cl.
*A47D 15/00* (2006.01)

(52) U.S. Cl. ..... 297/136; 297/182; 297/219.12

(58) Field of Classification Search ..... 297/136, 297/182, 219.1, 219.12
See application file for complete search history.

(56) References Cited

U.S. PATENT DOCUMENTS

| | | | | | |
|---|---|---|---|---|---|
| 2,532,932 | A * | 12/1950 | Neiswander | ..... | 2/49.2 |
| 2,594,053 | A * | 4/1952 | McKewen | ..... | 2/49.5 |
| 2,643,384 | A * | 6/1953 | Thompson | ..... | 2/49.3 |
| 2,700,413 | A * | 1/1955 | Williams | ..... | 297/182 |
| 2,767,403 | A * | 10/1956 | Givens | ..... | 297/465 |
| 2,905,943 | A * | 9/1959 | Carlisle et al. | ..... | 2/49.5 |
| 5,678,888 | A * | 10/1997 | Sowell et al. | ..... | 297/256.17 |
| 5,732,999 | A * | 3/1998 | Petrie | ..... | 297/136 |
| 6,676,210 | B1 * | 1/2004 | Peyton | ..... | 297/219.12 |
| 6,786,546 | B2 * | 9/2004 | McConnell et al. | .... | 297/219.12 |
| 7,029,066 | B1 * | 4/2006 | Myers-Jones | ..... | 297/219.1 |

* cited by examiner

*Primary Examiner*—Peter R. Brown

(57) ABSTRACT

A child seat apparatus includes a seat portion sized and dimensioned to receive a child and a tray portion substantially surrounding the seat portion so as to provide a surface for preventing an object from falling to the ground. The child seat apparatus further includes a loop member connected to the tray portion for keeping the tray portion taut or for collapsing the child seat apparatus.

20 Claims, 4 Drawing Sheets

CHILD SEAT APPARATUS

CROSS-REFERENCE TO RELATED APPLICATION

The present application claims priority to U.S. Ser. No. 60/959,408, filed on Jul. 13, 2007, the entire contents of which are hereby incorporated by reference in their entirety.

TECHNICAL FIELD

The present invention relates generally to a child seat apparatus, and more particularly, but not by way of limitation, to an improved child seat apparatus for preventing food and objects from falling to the floor.

BACKGROUND OF THE INVENTION

A family with small children, such as babies or toddlers, who go to a restaurant or other such facility for dining often utilize a standard restaurant high chair or child seat. Typically, the standard restaurant high chair or child seat is made from wood, plastic or other such material and only includes a place for the child to sit. The high chair provides restraints, such as a belt, to be placed around the waist of the child placed therein. The child is strapped in the high chair, and the high chair is typically positioned in proximity to the table so that the child utilizes a table surface for eating or performing other activities, such as playing with a toy, coloring, etc.

Typically, small children tend to throw or drop food, toys, or other such objects on the floor or ground while sitting at the table in a restaurant. The dropping of toys or food can disrupt a table conversation, creates noise and distraction, requires the parent or care giver to repeatedly pick the dropped toys off the floor causing frustration to both child and parent and also precludes re-use of the toy or food because of contact with the floor.

In addition, high chairs are normally not very clean having been dirtied by other children when dining at a restaurant. Typically, a child places their hands or mouth on the high chair surfaces, thus placing the child in contact with bacteria and other various disease-causing germs that may lead to illness.

To this end, although child seat covers of the existing art are operable, further improvements are desirable to enhance the use of a child seat apparatus which functions to prevent food, toys and other objects from falling to the floor, prevent child contact with the high chair and table surfaces, and extend the reachable playing surface for the child. It is to such a child seat apparatus that at least one embodiment of the present invention is directed.

BRIEF SUMMARY OF THE INVENTION

To overcome shortcomings of the known art, at least one embodiment of the present invention is directed to a child seat apparatus formed with (i) a seat portion that is sized and dimensioned to receive a child, and (ii) a tray portion adapted to provide a utility surface adjacent to the child for retaining objects within the child's reach and/or preventing the child from direct contact with a seat or table surface.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE OF THE INVENTION

Figure 1:
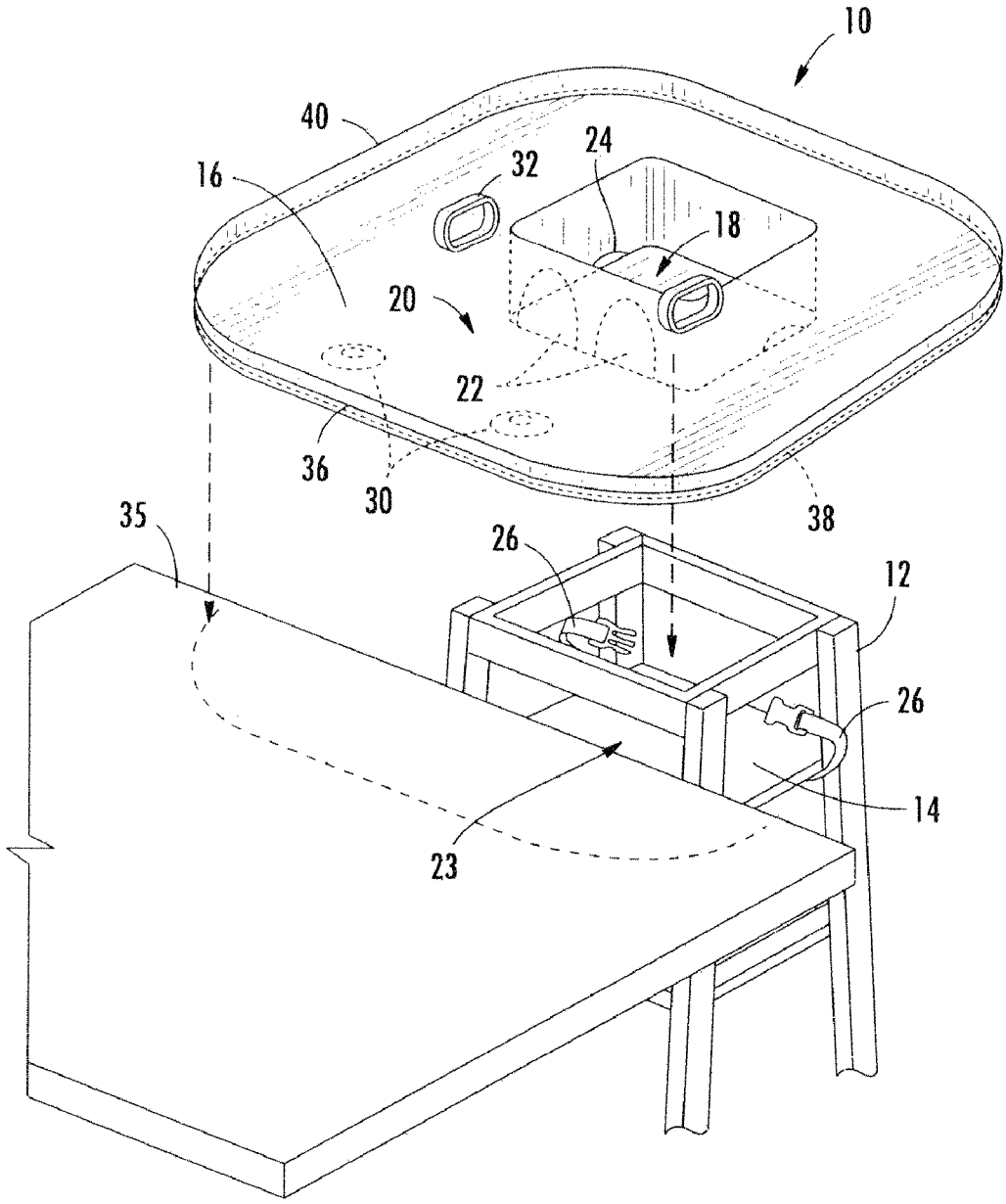
FIG. 1 is a perspective view of a child seat apparatus constructed in accordance with the present invention, the child seat apparatus being disposed on a high chair.

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. It is also understood that, for purposes of clarity, like reference numerals identify like structures in each of the figures.

Referring now to the drawings, shown therein is a child seat apparatus 10 constructed in accordance with embodiments of the present invention, the child seat apparatus 10 being shown disposed on a high chair 12 (FIG. 1). The high chair 12 has a seat 14, shown in FIG. 1, and is a conventional high chair utilized in most restaurants and known to one of ordinary skill in the art. Thus, no further description of the high chair 12 is believed necessary for one of ordinary skill in the art to understand and practice embodiments of the present invention. However, it should be understood that any variety of high chairs may be utilized with the child seat apparatus 10 as long as the child seat apparatus 10 functions in accordance with embodiments of the present invention. Further, it should be understood that the child seat apparatus 10 may be adapted to be utilized with any other type of child seat, including but not limited to a car seat, stroller seat, booster seat, Bumbo style baby seat, and the like, for example.

The child seat apparatus 10 may be constructed from a light-weight foldable material to enhance portability. Suitable materials for construction include woven, non-woven fabric, flexible plastic film materials such as vinyl, plastics, polymeric materials, and composite materials. The material may be water-resistant or waterproof so that the child seat apparatus 10 may be easily cleaned and/or disinfected after use. However, the child seat apparatus 10 may be constructed from any washable material as well. In addition, the child seat apparatus 10 may be constructed from any disposable material, such as a disposable waxed or coated flexible paper or thin plastic. The child seat apparatus 10 may also be constructed in any of a variety of colors and patterns The child seat apparatus 10 material may also be formed of a mesh or net-like material, designed to catch solid objects but allow fluids to pass. Further, it will be appreciated that the child seat apparatus 10 can be sized and shaped from any suitable material, that (completely or partially) surrounds the child in a manner that prevents objects from escaping the child's reach, prevents child contact with other surface areas, extends the child's playing surface, and/or otherwise functions as described herein.

In one embodiment, the child seat apparatus 10 includes a body 16 having a seat portion 18 and a tray portion 20. The seat portion 18 is sized and dimensioned to fit the seat 14 of the high chair 12, or other suitable seat types. The seat portion 18 may be formed of a selectively expandable material adapted to receive the lower body portion or torso of a child. The seat portion 18 is provided with apertures 22 for allowing legs of a child to be positioned there-through. The apertures 22 are positioned in the seat portion 18 and oriented with the leg opening(s) 23 of the high chair 12, as necessary, to receive the legs of the child. The seat portion 18 is also provided with apertures 24 for passage of straps 26 that form a high chair belt. Passage of the straps 26 through the apertures 24 allows the straps 26 to be positioned around the child's waist and fastened, if desired. Belt fasteners are generally known in the art and may include clips, snaps, hook and loop, buckles, and the like, so that the child is secured in the seat portion 18 of the child seat apparatus 10 and to the high chair 12.

As shown in FIGS. 1-4, the tray portion 20 substantially surrounds the seat portion 18 of the child seat apparatus 10 so as to provide a utility, play and/or eating surface or tray to prevent food, toys, pacifiers, etc., from falling to the floor during restaurant visits. The surface of the tray portion 20 prevents child contact with high chair or table surface areas, and may be sanitized with cleaning agents as desired It should be understood that the tray portion 20 may partially or completely surround the seat portion 18. In alternative embodiments, however, the tray portion 20 surrounds only a portion of the seat portion 18. The tray portion 20 may be permanently or removably connected to the seat portion 18. The tray portion 20 is shown as substantially circular in shape, however, it should be understood that the tray portion 20 may be any shape, such as oval, square, rectangular, triangular, polygonal, quadrilateral, ellipsoidal and the like, for example. Top side restraint straps 32 may be attached to the front and sides of the tray portion 20 for holding toys or other objects within reach of the child to teethe on or play with during restaurant visits. Under side restraint straps (not shown) are optionally attached on the underside of the tray portion 20 or seat portion 18 to secure the child seat apparatus 10 to a child seat or other structure. Fasteners, such as suction cups 30 are optionally attached to the underside of the tray portion 20 for securing the tray portion 20 to a table 35 or other structure.

The child seat apparatus 10 includes a loop member 38 attached to the tray portion 20 at a position near the outer perimeter of the tray portion 20. The loop member 38 keeps the tray portion 20 taut when the child seat apparatus 10 is in an extended position. The loop member 38 may be constructed or formed of any light weight, flexible, foldable or resilient material, such as steel wire, plastic, nylon, etc., that is sized and dimensioned such that the loop member 38 tends to return to such dimension after flexing or bending. The loop member 38 may also be formed of a malleable or impressionable material, such as copper wire, metal alloy or injection molded material that may be shaped and reshaped to achieve a desired dimension, which is useful when the child seat apparatus 10 is set up to rest upon support structures of different heights and sizes. The loop member 38 is flexed to collapse the child seat apparatus 10 into a smaller circular form for storage in a bag or simply for easier movement from one location to another when the child seat apparatus 10 is in a collapsed position (See FIGS. 5-6). The loop member 38 may be covered with a piece of material to attach it to the body 16, or disposed in a protective channel integrated with a rim 36 extending circumferentially circumferentially around the tray portion 20, so as to enable the folding features of the child seat apparatus 10. The protective channel may also prevent contact by a child or other individual with the loop member 38 (See FIG. 2). The loop member 38 may also be removable from the child seat apparatus 10. In an alternative embodiment, the loop member 38 is rigid so that the body 16 tends to retain a single shape. It should be understood that the shape of the collapsible child seat apparatus 10 may vary depending on the shape of the tray portion 20 of the child seat apparatus 10.

In another embodiment, a border 40 extends in a generally vertical direction a distance from the rim 36 so as to contain food, toys, pacifiers, or other objects that are thrown, dropped or might otherwise be dropped on the floor. The ability to contain food provides benefit to the public health by preventing excessive food scrap under high chars, which when quickly cleaned by staff, often leaves residue and crumbs which attract insects and vermin. The border 40 may be constructed out of the same or different material than that used to construct the tray portion 20. The border 40 may be permanently or removably connected to the tray portion 20.

Figure 3:
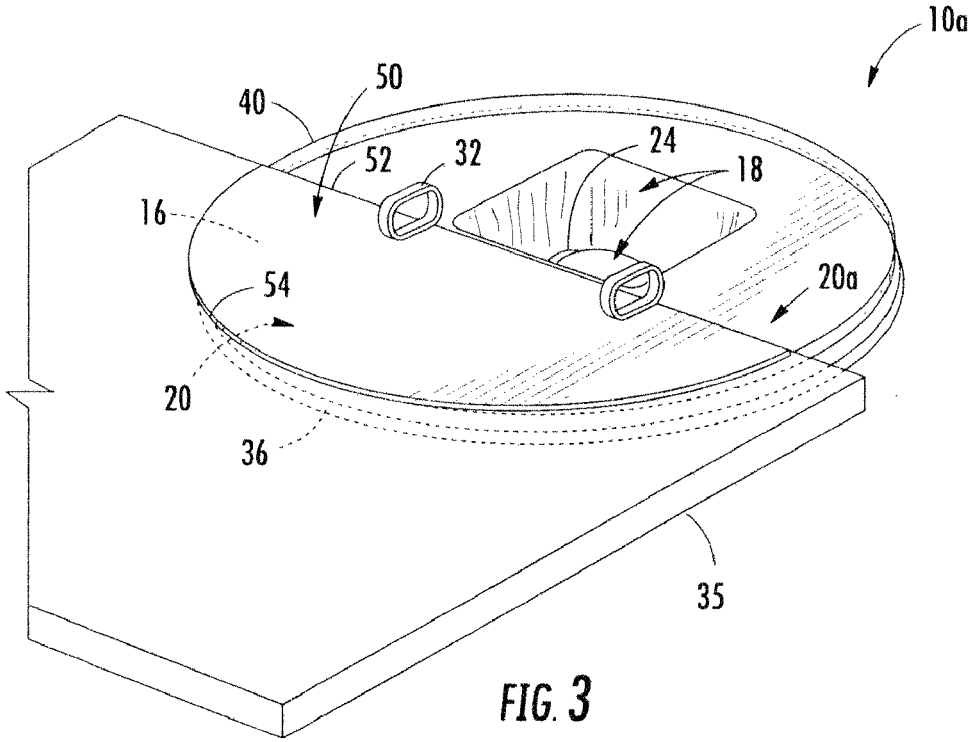
FIG. 3 is a perspective view of another embodiment of a child seat apparatus constructed in accordance with the present invention.

Referring to FIG. 3, an alternative embodiment is shown of a child seat apparatus 10*a* substantially similar to the child seat apparatus 10 except as described herein. The child seat apparatus 10*a* includes a first tray portion 20*a* and a second tray portion 50. The second tray portion 50 is a flap having a first end 52 and a second end 54. The second end 54 of the second tray portion 50 is selectively attachable to the first tray portion 20*a* of the child seat apparatus 10*a*, or alternatively, to the seat portion 18 of the child seat apparatus 10*a* and extends out in a direction away from the seat portion 18 of the child seat apparatus 10*a*. The first end 52 of the second tray portion 50 is selectively attachable to the table 35 by any suitable fastener known to one of ordinary skill in the art. The first tray portion 20*a* of the child seat apparatus 10*a* is selectively attachable under the table 35 by any suitable fastener known to one of ordinary skill in the art. Fasteners, such as suction cups, may be attached to a front portion of the first tray portion 20*a* or of the second tray portion 50 of the child seat apparatus 10*a* for securing the first tray portion 20*a* or the second tray portion 50 of the child seat apparatus 10 to the table 35.

Figure 4:
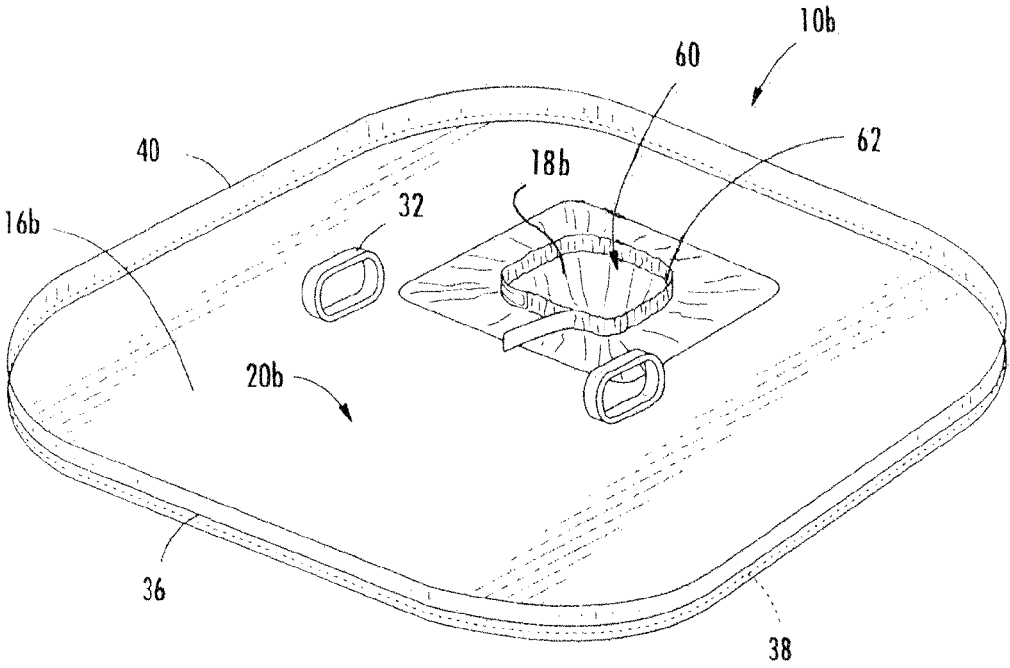
FIG. 4 is a perspective view of another embodiment of a child seat apparatus constructed in accordance with the present invention.

Referring now to FIG. 4, another embodiment is shown of a child seat apparatus 10*b* constructed in accordance with the present invention. The child seat apparatus 10*b* includes a body 16*b* and a tray portion 20*b*. The tray portion 20*b* is provided with an opening 60 that is sized and dimensioned to receive a lower body portion or a torso of a child. The opening 60 is provided with an edge 62 and may be constructed from an elastic or gathered material so that the child seat apparatus 10*b* may be positioned or fitted about the lower body portion or torso of the child. The edge 62 may also be sized and resized for a close fit to the child's body to seal out food, toys, other objects or debris. The tray portion 20*b* surrounds at least a portion of the opening 60 so as to provide a surface for preventing an object from falling to the ground. Optionally, a seat portion 18*b* may be connected to the edge 62. The seat portion 18*b* may be formed of an elastic, gathered, or selectively expandable material that is adapted to size and resize according to the size and shape of a child. In addition, it should be understood by one of ordinary skill in the art that any means for securing one object to another known in the art, such as a belt, may be utilized with the child seat apparatus 10*b* for securing a child to the child seat apparatus 10*b* and child seat. It will be appreciated that the structures of FIG. 4 are substantially similar or the same as structures identified by like reference numerals described elsewhere herein.

Figure 5:
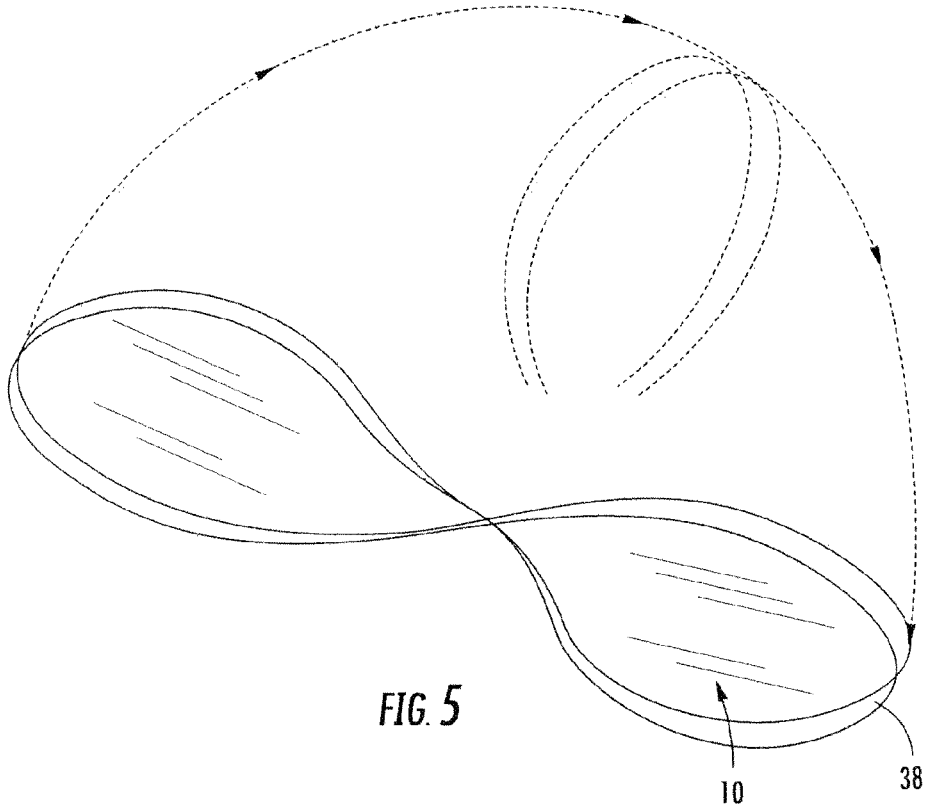
FIG. 5 is a pictorial representation of an embodiment of the child seat apparatus moved between an expanded position and a collapsed position.
Figure 6:
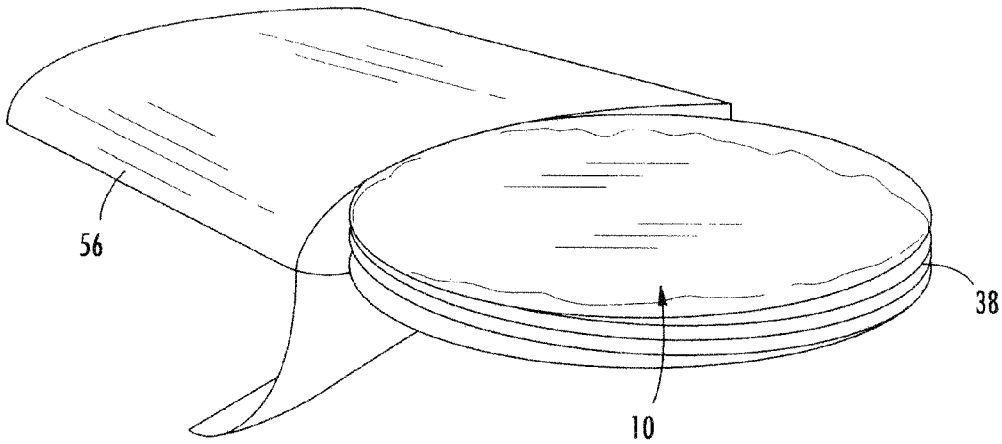
FIG. 6 is a perspective view of an embodiment of the child seat apparatus in the collapsed position being disposed in a bag.

Referring to FIGS. 5 and 6, in the collapsed position, the child seat apparatus 10 is twisted and folded to collapse the loop member 38 into a smaller diameter form. The seat portion 18 collapses with the tray portion 20 and a bag 56, or other such portable carrying device, may be used to hold the collapsed child seat apparatus 10 in the collapsed position. The bag 56 may be constructed from the same material as the child seat apparatus 10. Alternatively, the bag 56 may be constructed from a mesh-like material such as, for example, the mesh bags used to wash delicate fabrics, etc., such that the child seat apparatus 10 may be completely washable in the bag 56.

In the expanded position, the collapsed child seat apparatus 10 is untwisted and unfolded so that the loop member 38 expands to spread out to the substantially circular child seat apparatus 10 such that the seat portion 18 extends down below the tray portion 20. In the expanded position, the loop member 38 keeps the tray portion 20 taut.

Figure 2:
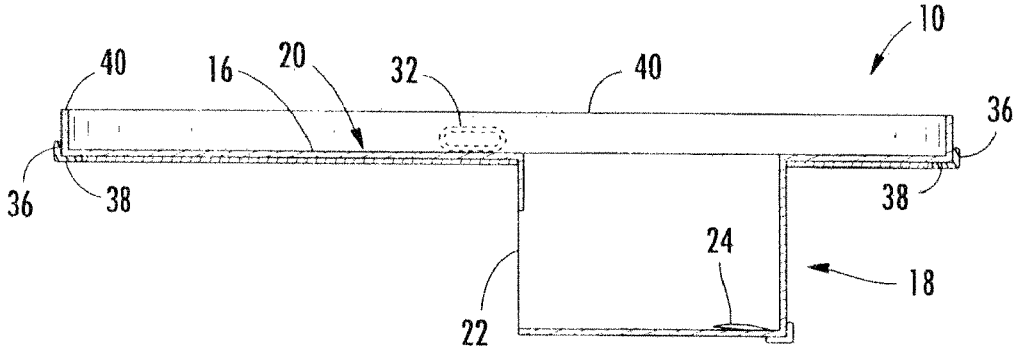
FIG. 2 is an elevational, partial cross-section view of a seat portion of the child seat apparatus of FIG. 1.

Referring now to the embodiment of FIGS. 1-3, in use, at a restaurant, the seat portion 18 of the child seat apparatus 10 is positioned in the seat of the high chair 12. The straps 26 of the high chair belt are passed though the apertures 24. A child is placed in the seat portion 18 of the child seat apparatus 10 and the straps 26 of the high chair belt are fastened around the child. Toys and food are given to the child. When the toys or food are dropped, the toys or food are contained on the tray portion 20 of the child seat apparatus 10, e.g., within the child reachable area of the tray portion 20, thus preventing the toys or food from falling to the floor of the restaurant and extending the play surface. The child seat apparatus 10 may be brought to the restaurant by a family or may be provided to the family by the restaurant. In addition, although an example of use of the child seat apparatus 10 is given in a restaurant, it should be understood that the child seat apparatus 10 may be used anyplace with a high chair so as long as the child seat apparatus 10 functions as described herein.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed:

1. A child seat apparatus, comprising:

a seat portion sized and dimensioned for receiving a child and for substantially fitting into the seat of a child seat; and a tray portion substantially surrounding the seat portion, the tray portion having a flexible, resilient, semi-rigid loop member attachable to the tray portion at a position substantially near the outer perimeter of the tray portion such that the loop member holds the tray portion in a flat condition to form a planar surface extending about the seat portion for preventing an object from falling to the ground.

2. The child seat apparatus of claim 1 wherein the tray portion is formed of a lightweight foldable material.

3. The child seat apparatus of claim 1 further including a border, wherein the border is connected to the tray portion such that the border extends in a generally vertical direction a distance from the tray portion for preventing an object from falling off the surface of the tray portion.

4. The child seat apparatus of claim 1 wherein the loop member is movable between an extended position and a collapsed position, in the extended position, the loop member holds the tray portion in the flat condition so that the tray portion is taut to form the substantially planar surface, in the collapsed position, the loop member is flexed to collapse the child seat apparatus into a smaller form.

5. The child seat apparatus of claim 1 further comprising at least one restraint strap connected to the tray portion of the child seat apparatus for positioning a toy or object within the child's reach.

6. The child seat apparatus of claim 1 wherein the child seat is a high chair, a stroller seat, a booster seat, a car seat or other style of child seat.

7. The child seat apparatus of claim 1, further comprising:

a second tray portion having a first side and a second side such that at least a portion of the second side of the second tray portion is selectively attachable to a surface of the tray portion of the child seat apparatus for providing another surface for the child seat apparatus.

8. The child seat apparatus of claim 7 wherein the second tray portion extends out a direction away from a front portion of the seat portion of the child seat apparatus.

9. The child seat apparatus of claim 7 wherein at least a portion of the first side of the tray portion is selectively attachable under a table by a fastener so that the tray portion is secured to the table.

10. A child seat apparatus, comprising:

a tray portion formed of flexible foldable material having an opening sized and dimensioned for receiving a child, such that the opening is positioned about and surrounding a lower body portion of the child, wherein the tray portion surrounds at least a portion of the opening, the tray portion having a flexible, semi-rigid or rigid loop member attached near an outer perimeter of the tray portion for holding the tray portion in a flat condition to provide a substantially planar surface for preventing an object from falling to the ground.

11. The child seat apparatus of claim 10 wherein the tray portion is formed of a light-weight foldable material.

12. The child seat apparatus of claim 10 further including a border connected to the tray portion, wherein the border extends in a generally vertical direction from the tray portion to prevent an object from falling off the surface.

13. The child seat apparatus of claim 10 wherein the loop member is formed of a resilient, foldable, collapsible, malleable or impressionable material.

14. The child seat apparatus of claim 10 further comprising at least one restraint strap connected to the tray portion for positioning a toy with the child's reach.

15. A child seat apparatus, comprising:

a seat portion sized and dimensioned for receiving a child and for fitting into the seat of a child seat; and a tray portion formed of flexible foldable material connected to and surrounding the seat portion, the tray portion having a rigid loop member connected to the tray portion substantially near the outer perimeter of the tray portion such that the loop member holds the tray portion in a flat condition so that the tray portion forms a substantially planar surface for preventing an object from falling to the ground.

16. The child seat apparatus of claim 15 wherein the loop member is disposed in a protective channel positioned circumferentially around the tray portion.

17. The child seat apparatus of claim 15, wherein the tray portion is sized and shaped to prevent objects from failing of the surface.

18. The child seat apparatus of claim 15 wherein the seat portion is formed of a selectively expandable material adapted to receive at least a portion of a child.

19. The child seat apparatus of claim 15 wherein the tray portion is provided with at least one suction cup for securing the tray portion to an adjacent structure to provide stability and support to the tray portion of the child seat apparatus when the child seat is used with the adjacent structure.

20. The child seat apparatus of claim 15 wherein the tray portion and seat portion are adapted to be folded into a smaller form and inserted into a portable carrying device.

* * * * *